United States Patent [19]

Yaji et al.

[11] Patent Number: 4,553,604

[45] Date of Patent: Nov. 19, 1985

[54] METHOD OF CONTROLLING CONTINUOUS CASTING EQUIPMENT

[75] Inventors: Motoyasu Yaji; Masuto Shimizu; Hiromitsu Yamanaka; Takao Koshikawa, all of Chiba, Japan

[73] Assignee: Kawasaki Steel Corporation, Hyogo, Japan

[21] Appl. No.: 537,403

[22] Filed: Aug. 31, 1983

[30] Foreign Application Priority Data

| | | | |
|---|---|---|---|
| Feb. 24, 1982 | [JP] | Japan | 57-29237 |
| Feb. 26, 1982 | [JP] | Japan | 57-31024 |
| Feb. 26, 1982 | [JP] | Japan | 57-31025 |
| Feb. 26, 1982 | [JP] | Japan | 57-31026 |
| Feb. 26, 1982 | [JP] | Japan | 57-31027 |

[51] Int. Cl.[4] ..... B22D 11/16

[52] U.S. Cl. ..... 164/453; 164/452; 164/455; 164/472; 164/491

[58] Field of Search ..... 164/451–455, 164/154, 155, 150, 413, 414, 472, 491

[56] References Cited

U.S. PATENT DOCUMENTS

| | | | |
|---|---|---|---|
| 3,926,244 | 12/1975 | Meier et al. | 164/455 |
| 4,006,633 | 2/1977 | Shipman et al. | 164/451 X |

FOREIGN PATENT DOCUMENTS

| | | | |
|---|---|---|---|
| 2415224 | 4/1974 | Fed. Rep. of Germany . | |
| 2901407 | 5/1979 | Fed. Rep. of Germany . | |
| 2223115 | 3/1974 | France . | |
| 112338 | 6/1979 | Japan . | |
| 33220 | 12/1979 | Japan . | |
| 124448 | 1/1980 | Japan . | |
| 55-54247 | 4/1980 | Japan | 164/155 |
| 55-109553 | 8/1980 | Japan | 164/453 |
| 39068 | 3/1982 | Japan . | |
| 2012637 | 7/1979 | United Kingdom . | |

*Primary Examiner*—Kuang Y. Lin

*Attorney, Agent, or Firm*—Parkhurst & Oliff

[57] ABSTRACT

Control method for preventing a breakout or/and a crack of the slab of continuous casting equipment. Heat flux waveforms or heat flux values commensurate to extracted heat values at various positions of a mold are measured by means of thin plate type surface heat flux meters (14, 14*x*, 14*y*, 14*z*) provided at various positions on side shell plate (11, 11*c*) of the mold (10). When an abnormality or a deviation from a target value is detected, pouring rate is changed, scope of supply, brands and the like of mold powder are controlled, or taper value of short sides of the mold is controlled, so that a breakout or/and a crack of the slab is prevented.

11 Claims, 23 Drawing Figures

METHOD OF CONTROLLING CONTINUOUS CASTING EQUIPMENT

DESCRIPTION

TECHNICAL FIELD

This invention relates to method of controlling continuous casting equipment for preventing occurrence of a breakout and/or a crack in a slab.

BACKGROUND ART

With the continuous casting in common practice at present, supply of a high temperature slab to a heating furnace for rolling has been a great question to be solved in the aspect of energy saving. Because of this, in the continuous casting operation, necessity has been voiced for high speed pouring and supply of a slab to a rolling section for a short period of time due to quick detection of surface defects. However, since the pouring rate is high during high speed pouring, the thickness of a solidified shell formed in the slab is small, and there is a possibility of occurrence of a so-called breakout, that is, the solidified shell may be broken off when the thin portion of the solidified shell reaches the lower end of a continuous casting mold (hereinafter referred to as the "mold") within the mold. However, occurrence of the breakout has not heretofore been accurately predetected. Hence, in order to avoid the breakout, the pouring rate is reduced beyond necessity. Or, after the breakout has occurred, an operation stop for several hours has been necessitated. On the other hand, surface defects such as longitudinal surface cracks are mainly caused due to the fact that the extracted heat value is varied by ununiformity of the mold powder flowing into a space between the mold and molten steel (slab), and particularly, the local decrease or increase thereof, whereby the formation of the solidified shell becomes ununiform. However, since surface defects have heretofore been detected through (1) a crack check and trimming after rolling, (2) a visual inspection after cooling of the slab, or (3) an inspection after the withdrawing and cooling of the slab and the like, such disadvantages have been presented that, (1) the process is carried out after the defects are detected, necessary feedback steps cannot be taken during the pouring operation, and thus the yield is lowered, (2) the slab need to be cooled, a unit consumption of the heating furnace is increased, or (3) defects cannot be fully detected.

As a method of predetecting the aforesaid breakout, there has heretofore been proposed one in which a distortion of a main shaft in an oscillation mechanism for oscillating a mold during pouring is measured to predetect a restraining breakout. However, this method is disadvantageous in that a breakout at a distortion of a low value cannot be detected and this method is applicable only during steady pouring (at a constant drawing rate).

There has been proposed a method, in which an oscillation waveform of the oscillation mechanism is measured and an abnormal waveform is detected to thereby predetect a breakout. However, this method is disadvantageous in that a fine variation cannot be obtained from the oscillation system itself.

Further, there has been proposed a method in which a bulging value of a portion bulged directly downwardly from the slab is measured to predetect a breakout. However, this method is statistical one, can indicate only a probability of occurrence of a breakout, and cannot directly detect the behavior in the mold.

On the other hand, it is a well known fact that all of the breakouts and surface defects as described above closely relate to a contacted state between the mold and the slab (that is, the heat extraction). It is conceivable that a breakout or a crack of the slab can be predetected through the measurement of the extracted heat value or the distribution thereof, because heat transfer to the mold is high in value through a thin portion of the solidified shell, or the distribution of the extracted heat value becomes ununiform when the contacted state between the mold and the slab becomes ununiform, for example. In consequence, there have heretofore been practised that, for example, as shown in FIG. 1, holes 11*b* are formed in the bottom portion of cooling water paths 11*a* provided on outer side surfaces of mold shell plates 11 forming a mold 10, thermocouples 12 are embedded in the aforesaid holes 11*b*, and a heat flux is determined through calculation of a temperature gradient detected from outputs of the thermocouples embedded at two points spaced apart from each other in the direction of depth so as to detect the heat extraction. However, with this method, not only thermal agitation occurs due to the embedding of the thermocouples 12, but also the thermocouples need to be embedded at accurate positions because, if the embedded positions are shifted by 1 mm for example, then there occurs an error of 5° to 10° C., so that great difficulties are encountered in the embedding operation. Furthermore, when an extracted heat value Q is calculated from detected temperatures $T_1$ and $T_2$ from the two thermocouples, an interval d across the embedded positions and a thermal conductivity λ of a mold 10 in accordance with the following equation, errors may be caused to the detected temperatures $T_1$ and $T_2$ due to the thermal agitation, and moreover, an error may be caused to the interval d due to an error in the embedded position, to thereby easily cause errors.

$$Q=\lambda(T_1-T_2)/d \quad (1)$$

Further, it is impossible to directly indicate and record a heat flux. Furthermore, the variations in value of the outputs from the thermocouples at the time of breakout or occurrence of surface defects are comparatively low as shown in FIG. 2 (the case of breakout), a change in temperature increase such as 5° to 10° C. in short time interval must be inspected in order to sense a breakout for example, so that difficulties are encountered in determining the breakout. Further, with the thermocouples, exact numerical values including a change in temperature at the time of a breakout, a change in temperature at the time of occurrence of surface defects and the like cannot be grasped due to factors such as a change in the thickness of mold caused by wear of the slab, errors in the embedding of the thermocouples themselves and the like. In the case of occurrence of a longitudinal crack, if a variation in numerical value is small, then the occurrence of the defect cannot be detected. Further, such disadvantages have been presented that the embedding of the thermocouples in holes formed in the mold side plate shortens the service life of the mold, reinstalment is difficult to conduct and so forth.

On the other hand, it is very important for controlling the surface quality of a slab to control the behavior of heat extraction of the mold. In consequence, there has heretofore been developed a semi-automatic supply system capable of mechanically supply an input of the mold powder, which has been manually preset, so as to quantitatively grasp the input of the mold powder rendering influences onto the the behavior of heat extraction as commensurate to the progress of the continuous casting. However, since the presetting of the amount of supply of the mold powder, scope of supply, brands, mixture ratio and the likes have heretofore been conducted on the basis of the results of the visual determination of the dissolved condition of the powder through the observation and the like of the molten steel surface made by an operator, such disadvantages have been presented that local changes of the powder flow-in conditions in the mold cannot be sensed, a necessary feedback step for the quality of slab is belated, the extracted heat value is varied due to ununiformity in the amount of the mold powder flowing into a space formed between the mold and the molten steel (slab), particularly, the local decrease or increase, whereby the formation of the solidified shell becomes ununiform, so that surface defects such as a longitudinal crack and the like are caused to the slab, to cite the extreme case, a breakout occurs.

Further, in the continuous casting, a solidified shell is contracted during pouring. In consequence, shell plates on the short sides, which form the mold, are tapered, so that the solidified shell and the shell plates of the short sides can be brought into full contact with each other. However, in case the taper value of the shell plates of the short sides is small, the solidified shell and the mold are in insufficient contact with each other, whereby the cooling is not satisfactorily conducted and a slab goes out of the mold before the thickness of the solidified shell is developed, thus presenting a danger that cracks due to the static pressure of molten steel occur or the solidified shell is broken off to generate a breakout. On the contrary, in case the taper value of the shell plates of the short sides is excessively large, the solidified shell and the mold are violently brought into contact, thereby presenting a possibility that an excessive deforming stress acts on the solidified shell to break the same off or wear of the mold is intensified due to friction between the solidified shell and the mold, thus resulting in shortened service life of the mold. In consequence, the taper value has heretofore been set on the basis of experience prior to the start of pouring depending on the grade of steel, pouring rate and the like. After the start of pouring, the set taper value is changed in accordance with changes of the grade of steel, pouring rate and the like in the course of pouring, and thus, the operation is continued. However, the taper value set on the basis of the experience depending on the grade of steel, pouring rate and the like has not been set on the basis of direct study on the degree of contact between the solidified shell and the mold due to delicate variations in the mold powder, grade of steel and pouring rate, whereby there have occurred some cases where the set taper value is not suitable, thus causing surface defects such as side surface cracks, minute longitudinal cracks and the like of the slab.

The present invention has been developed to obviate the above-described disadvantages of the prior art and has as its object the provision of method of controlling continuous casting equipment, capable of easily and reliably predetecting occurrence of a breakout or a crack of a slab with high sensitivity throughout all of the operating conditions, thereby reliably preventing occurrence of a breakout or a crack.

Further, the present invention has as its object the provision of method of controlling continuous casting equipment, wherein heat flux meters capable of directly measuring heat fluxes are provided in suitable states, measuring a heat extraction of the mold with high accuracy and preventing the service life of the mold from being shortened.

Further, the present invention has its object the provision of method of controlling continuous casting equipment, wherein the heat flux meters can bes easily provided.

Furthermore, the present invention has its object the provision of method of controlling continuous casting equipment, capable of accurately measuring heat flux waveforms or heat flux values.

Furthermore, the present invention has as its object the provision of the method of controlling continuous casting equipment, wherein an optimum taper value can be quickly and precisely obtained as commensurate to changes in the contacted state between the solidified shell and the mold during operation, so that a breakout, a crack of the slab and a wear of the mold can be reliably prevented from occurring.

DISCLOSURE OF INVENTION

In the present invention, a heat flux waveform commensurate to an extracted heat value of a mold is measured by means of heat flux meter provided on outer surface of the side shell plate of the mold, and abnormality of the heat flux waveform is detected. In consequence, occurrence of a breakout or a crack of a slab can be predetected easily and reliably, so that a breakout or a crack of the slab can be reliably prevented from occurring.

Further, in the present invention, the aforesaid heat flux meter has sensor plate made of a material substantially equal in thermal conductivity to the side shell plate of the mold, and is closely attached to outer surface of the side shell plate so as to sense a heat extraction of the mold. In consequense, the reading of the indication of the heat flux meter enables to directly obtain the value of heat flux with high accuracy, and the contacted state between the mold and molten steel can be detected easier than in the case of the prior art, so that the feedback to the continuous casting operation can be conducted. Furthermore, the heat flux meters can be provided without forming holes in the mold. As the result, the heat flux meter can be easily provided, and moreover, there is no possibility of shortening the service life of the mold. Further, such advantages can be offered that the heat flux meters can be easily reinstalled at the time of replacing the mold with new one, and corresponding measures can be easily taken.

Furthermore, in the present invention, the aforesaid heat flux meter is provided in cooling water path formed on outer side surface of the side shell plate of the mold, and heat flux meter signal line is passed through the cooling water path and taken out through a water feed pipe, a water discharge pipe or a mold back plate. In consequence, the heat flux meters can be easily provided.

Furthermore, in the present invention, the aforesaid heat flux meter is housed in a case adapted to preclude heat conduction in heat flow non-sensing directions. In consequence, heat flux waveforms and heat flux values are measured accurately.

Furthermore, in the present invention, pouring rate is changed when a wave crest of the aforesaid heat flux waveform becomes abnormal. In consequence, a breakout of the slab can be reliably prevented from occurring.

Furthermore, in the present invention, pouring rate is changed when an amplitude of the aforesaid heat flux waveform becomes abnormal. In consequence, a crack in the slab can be reliably prevented from occurring.

Furthermore, in the present invention heat flux waveforms commensurate to extracted heat values at various positions of a mold are measured by means of heat flux meters provided at various positions on the outer surface of a side shell plate of the mold, and a scope of supply, mixture ratio and the like are controlled in order to obviate an abnormal condition when the heat flux waveforms become abnormal. In consequence, the mold powder can be quickly and precisely controlled, so that a breakout or a crack of the slab can be reliably prevented from occuring.

Furthermore, in the present invention a heat flux value commensurate to an extracted heat value of a short side of a mold is measured by means of heat flux meter provided on outer surface of a short side shell plate of the mold and a taper value of the short side of the mold is controlled as commensurate to a deviation between the heat flux value and a predetermined target value. In consequence, taper value can be quickly and precisely controlled as commensurate to the heat extraction of the short side of the mold, whereby the optimum thickness of the shell is secured, so that occurrence of a breakout, a crack or wear of the mold and the like can be avoided reliably.

According to the present invention, there is utilized a thin plate type surface heat flux meter which has been developed in recent years. As shown in FIG. 3, this surface heat flux meter 14 is operated in accordance with the fact that a heat flux Q flowing through a heat resistor plate 16 is given through the following equation after the heat flux meter 14 reaches the normal condition in the case where the thin heat resistor plate 16 having a thermal conductivity $\lambda$ and a satisfactorily small thickness d is secured to a surface of a solid body being under heat conduction.

$$Q=(\lambda/d)\Delta T \quad (2)$$

Where $\Delta T$ reprersents a temperature difference between the front and rear surfaces of the heat resistor plate 16. In consequence, if the thermal conductivity $\lambda$ and the thickness d are known, then the heat flux Q can be extracted through the electrical measurement of the temperature difference $\Delta T$ between sensor plates 18 provided on the front and rear surfaces of the heat resistor plate 16, respectively.

This thin plate type surface heat flux meter has the following characteristic features. (1) The heat flux meter need not be embedded in the mold and is capable of measuring from the outer surface of the cooling water path or the like. (2) The heat flux meter is compact in size and can be secured to any position. (3) Any local heat flux can be detected. (4) There occurs no change in output due to an error in the embedding as seen in the case of the thermocouples, only if the heat flux meter is mounted, then an accurate value of a heat flux can be obtained, and, even when a thermal agitation occurs, the occurrence can be ascertained through a calibration. (5) There is no need to catch a change from a certain level as seen in the case of the thermocouples, and, a breakout or a crack can be predetected directly through a measured value of a heat flux. The present invention has been developed on the basis of the above-described knowledge.

FIG. 4 shows an example of a heat flux waveform obtained by the heat flux meter 14 as described above. The wave crest H of this heat flux waveform a heat value extracted from the molten steel 22 to the side shell plate 11 of the mold 10 through the solidified shell 24*a* and the mold powder 25 as shown in FIG. 5, and represents a distance between the slab 24 and side shell plate 11 (sum of the thickness of a film of a mold powder 25 and air gaps), for example. In consequence, when the distance is small, the heat flux value, i.e., the wave crest H of the heat flux waveform becomes large. On the contrary, when the distance between the slab 24 and the side shell plate 11 is large or the flow-in amount of the mold powder is large, the wave crest H of the heat flux waveform becomes small, and the solidified shell 24*a* to be formed becomes thin, being directed in the direction of slow cooling. In FIG. 5, designated at 20 a pouring-in pipe and 15 a case for the heat flux meter 14. The wave crest H is normally $150\text{–}250\times10^4$ Kcal/m$^2$.hr (which differs depending on the pouring rate, mold powder, taper and the like) at a measuring point up to 100–300 mm from the molten steel surface. On the other hand, when the solidified shell 24*a* is broken off or thined out to thereby increase a possibility of occurrence of a breakout, the thermal resistance is lowered and the heat value from the molten steel 22 comes to be rapidly transferred to the side shell plate 11, whereby the wave crest H is abruptly increased beyond $300\times10^4$ Kcal/m$^2$.hr. In consequence, when the wave crest H of the heat flux waveform is monitored, occurrence of a breakout can be predetected from the fact that the wave crest H exceeds a predetermined value, e.g., $300\times10^4$ Kcal/m$^2$.hr. The present invention has been developed on the basis of the above-described knowledge.

In consequence, there is a suitable range for the wave crest H of the heat flux waveform from the viewpoint of preventing a breakout, surface defects on the slab, particularly a longitudinal crack from occurring. $100\times10^4$ Kcal/m$^2$.hr $<H<300\times10^4$ Kcal/m$^2$ hr is preferable as the heat flux value to prevent a breakout from occurring and avoid surface defects on the slab.

When the present inventors made a study on the changes of the heat flux waveform at the time of occurrence of a breakout by use of the above-described heat flux meters, the results shown in FIG. 6 were obtained. As apparent from FIG. 6, the wave crest H of the heat flux waveform began to rise at a time point $t_{11}$ and was abruptly changed at a time point $t_{12}$. If the pouring is continued in this condition, then the solidified shell is broken off and brought into a breakout at a time point $t_{13}$. In consequence, the pouring rate is decreased at the time point $t_{11}$ or $t_{12}$ so as to increase the thickness of the solidified shell and a low speed pouring is carried out until the extracted heat value is restored, so that a breakout can be prevented in advance. When the extracted heat value is not restored even if the low speed pouring is carried out, it is desirable to discontinue the pouring.

When an extremely excessive powder flow-in occurs, the heat flux from the slab to the mold is locally reduced. In other words, the wave crest H is decreased to a considerable extent. In this case, a step similar to the above may be preferably taken.

Furthermore, the amplitude W of the aforesaid heat flux waveform shows a uniformity of the extracted heat value between the molten steel 22 and the side shell plate 11, and represents ununiformity, in thickness of a film layer of the mold powder 25 which has flowed into a space formed between the slab 22 and the side shell plate 11. In consequence, when minute surface cracks occur due to a slag inclusion phenomenon caused by abnormal flow-in of the mold powder 25 and the like, the amplitude W at positions, where the cracks occur, is increased. In consequence, when the amplitude W of the heat flux waveform is monitored, occurrence of a large surface crack can be predetected from the fact that the amplitude W exceeds a predetermined value, e.g., $60\times10^4$ Kcal/m$^2$.hr. The present invention has been developed on the basis of the above-described knowledge.

In case where occurrence of a surface crack is predetected, in order to prevent the surface crack from developing, the pouring rate is decreased to return to the former pouring rate again, for example. Or, in case the amplitude W of the heat flux waveform is not restored even if the pouring rate is returned to the former pouring rate, the situation is countered by a change in operating conditions such as a change of mold powder, so that a crack in the slab can be prevented from occurring.

In consequence, from the viewpoint of preventing a breakout, surface defects on the slab, particularly a longitudinal crack from occurring, the amplitude W is preferably as small as possible. For example, $W<60\times10^4$ Kcal/m$^2$.hr is preferable.

Additionally, as the case may be, it is observed that the cycle of the aforesaid heat flux waveform is varied from a value during the steady period. This means that a varing cycle of a minute gap between the side shell plate and the solidified shell of the slab is different from that during the steady period. If the cycle becomes abnormal, and for example, it becomes very long, then it indicates that the solidification is not in progress in the normal condition, so that occurrence of a breakout or a crack of the slab can be predetected through the cycle.

Further, occurrence of a breakout or a crack can be reliably predetected not only from all of individual data including the wave crest, amplitude and cycle of the heat flux, but also from two or three of those data.

As apparent from the above-described knowledge, if the amount of supply of the mold powder, scope of supply, brands, mixture ratio and the like are controlled so that the wave crest H, amplitude W and/or cycle of the heat flux waveform obtainable by the aforesaid heat flux meter can remain within the aforesaid ranges or in a steady value when an abnormality occurs with the wave crest H, amplitude W and/or cycle, then a breakout can be prevented from occurring and surface defects on the slab can be avoided. The present invention has been developed on the basis of the above-described knowledge.

Further, when the above-described heat flux meter 14 is provided in the short side shell plate of the mold 10 as shown in FIG. 5 the heat flux value Q to be measured by the heat flux meter 14 is determined by the relationship between the thickness of the solidified shell 24*a* and the degree of contact between the short side shell and the solidified shell 24*a*. Here, when the thickness of the solidified shell 24*a* is given l(m), the thermal conductivity in the solidified shell 24*a* λs (Kcal/mhr°C.), the heat transfer rate between the solidified shell 24*a* and the short side shell plates with the mold powder 25 being taken into account H (Kcal/m$^2$hr°C.), the distance from the surface of the mold to the heat flux meter 14 D and the thermal conductivity of the mold λm (Kcal/mhr°C.), if such assumption is made that the condition illustrated in FIG. 5 may be expressed by a steady one-dimentional heat conduction, then the heat flux value Q will be expressed through the following equation.

$$Q = \frac{Ts - Tw}{\frac{d}{\lambda m} + \frac{1}{H} + \frac{l}{\lambda s} + \frac{1}{n}} \quad (3)$$

where Ts represents the temperature (°C.) of the solidified shell 24*a* at the molten steel's side, Tw the temperature (°C.) of cooling water flowing outside the mold and h the heat transfer rate of the cooling water. In the equation (3), the temperature Ts of the solidified shell 24*a* at the molten steel's side, temperature Tw of the cooling water, distance D from the surface of the mold to the heat flux meter 14, thermal conductivity λm of the mold 10 and thermal conductivity λs in the solidified shell 24*a* are considered to be substantially constant, respectively, whereby the heat flux value Q may be substantially determined by the relationship between the thickness 1 of the solidified shell and the heat transfer rate H between the solidified shell and the mold, after all. In consequence, a high heat flux value Q indicates the rapid development of the solidified shell 24*a*. In the high speed pouring during continuous casting, it is necessary to secure a satisfactory thickness of this sell. In order to do this, thes heat flux value Q must be satisfactorily high. In consequence, the taper value of the short side shell plates of the mold should be adjusted to increase or decrease the contact between the mold and the solidified shell, so that the heat transfer rate H between the solidified shell and the mold can be maintained at a certain value. The present invention has been developed on the basis of the above-described knowledge.

In addition, with the actual mold, it is difficult to make the aforesaid one-dimentional condition, and consequently, it is difficult to accurately express through the equation (3). However, essentially, the similar situation is brought about. More specifically, when the heat flux value Q is low, the taper value should be increased, whereby the value of the contact between the solidified shell and the mold is increased, so that the heat transfer rate H can be increased to increase a heat value extracted to the mold. On the contrary, when the heat flux value is high, the taper value should be decreased in order to avoid wear of the mold, whereby the value of contact between the mold and the solidified shell is decreased, so that wear can be avoided.

BEST MODE FOR CARRYING OUT THE INVENTION

Detailed description will hereunder be given of one embodiments of the continuous casting equipment, to which is adopted the methods of controlling according to the present invention with reference to the drawings.

Figure 1:
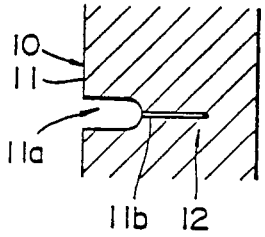
FIG. 1 is sectional view showing the state where the thermocouple for sensing the heat extraction is embedded in the mold for continuous casting.
Figure 2:
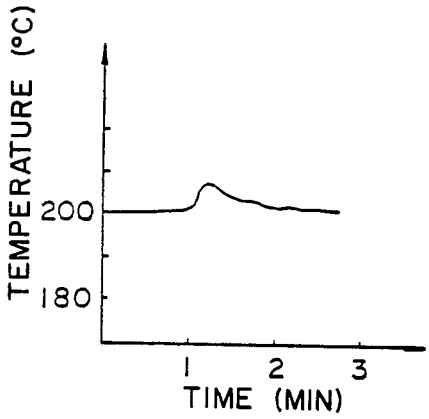
FIG. 2 is a graphic chart showing an example of an output woveform obtainable by the thermocoupes.
Figure 3:
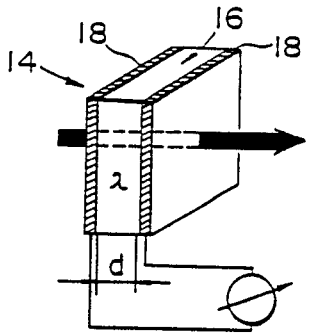
FIG. 3 is a perspective view showing the theoretical arrangement of the heat flux meter in use for the method of controlling continuous casting equipment according to the present invention.
Figure 5:
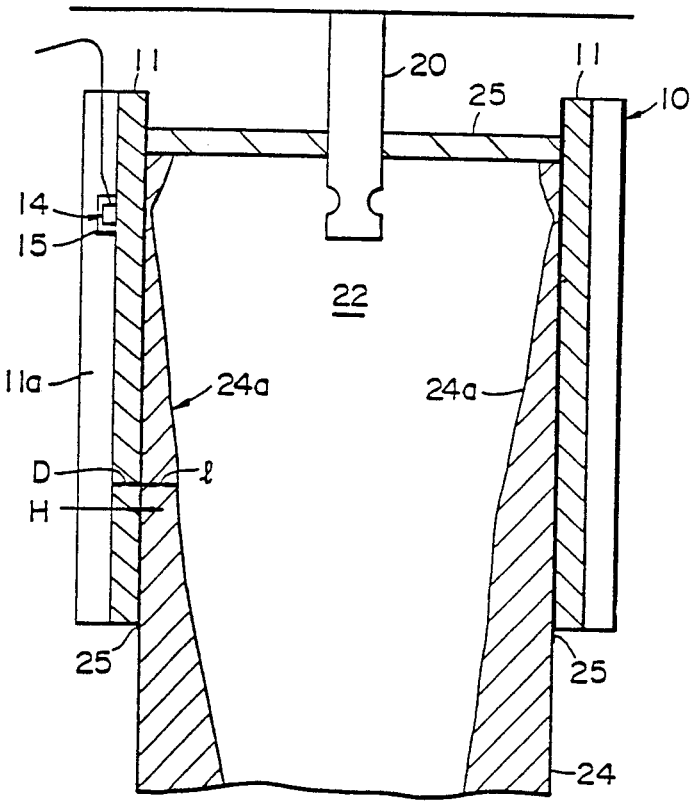
FIG. 5 is a sectional view showing the relationship between the molten steel and the heat flux meter in a state where the solidified shell is broken off.
Figure 6:
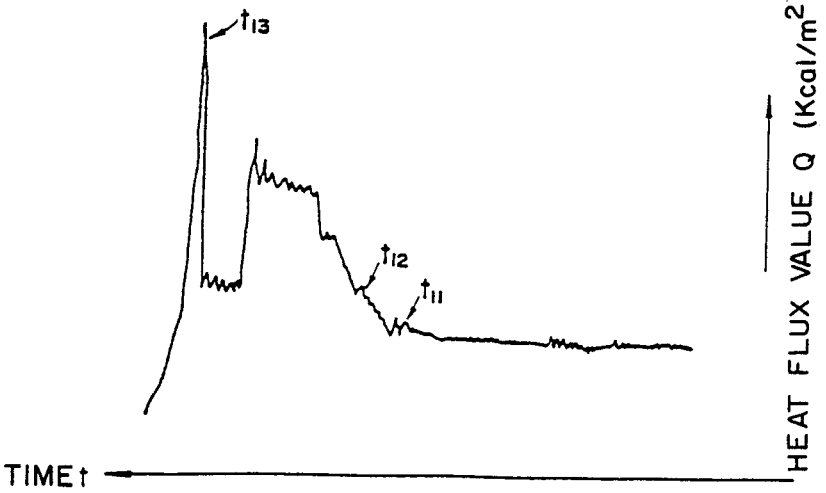
FIG. 6 is a graphic chart showing an example of the progress of change in the heat flux waveform when a breakout occurs.
Figure 7:
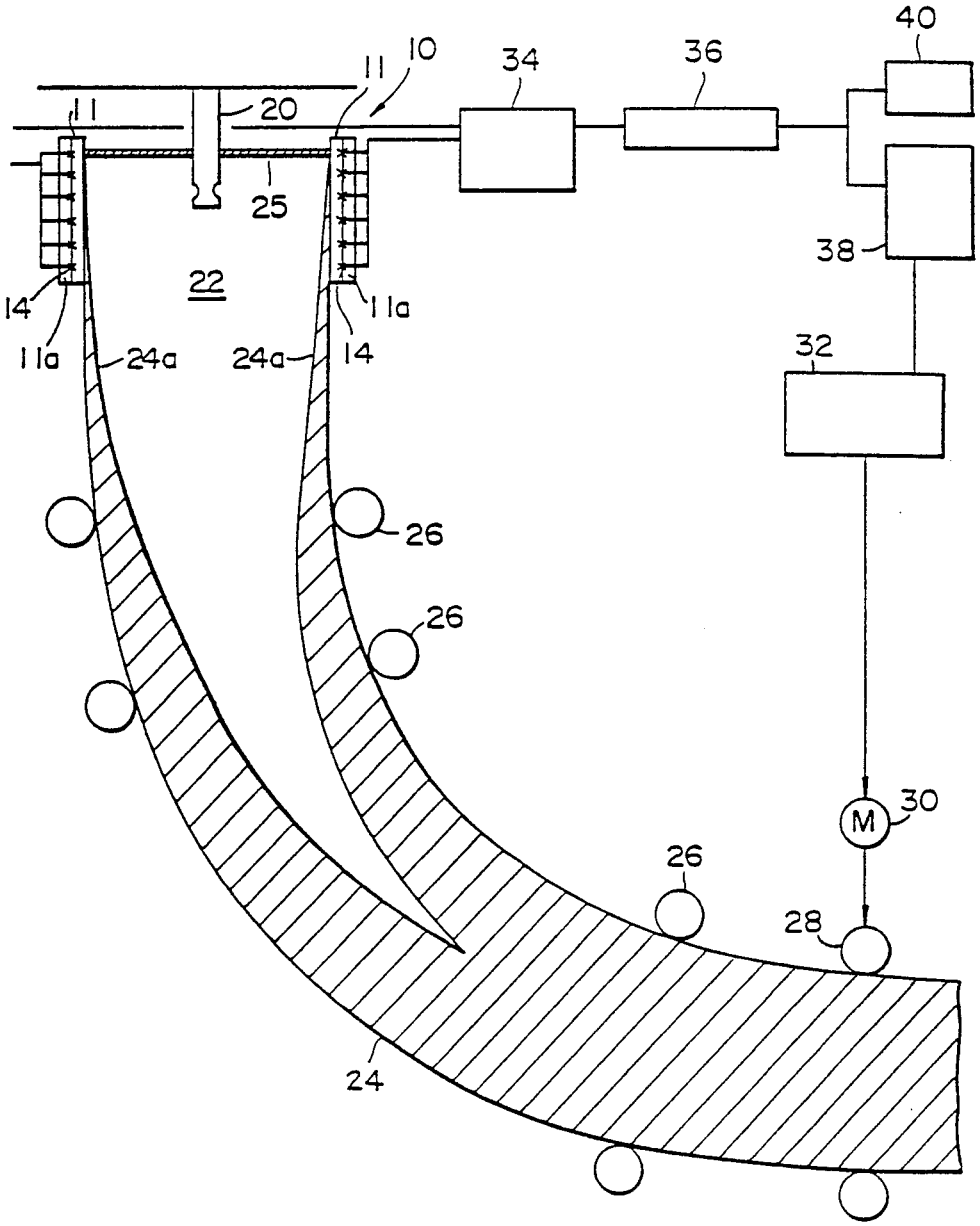
FIG. 7 is a sectional view partially including a block diagram, showing the general arrangement of the continuous casting equipment, to which is adopted the first embodiment according to the present invention.

As shown in FIG. 7, in the first embodiment according to the present invention, in a continuous casting equipment similar to the conventional one, comprising: a mold 10 for cooling molten steel 22 poured from above through a pouring pipe 20 and forming a slab 24; guide rollers 26 for guiding the slab 24; pinch rolls 28 for withdrawing the slab 24; a motor 30 for rotatably driving the pinch rolls 28; and a pinch roll driving device 32 for controlling the motor 30; the thin plate type surface heat flux meters 14 each having sensor plates 18 (FIG. 3) made of a material (e.g., copper) substantially equal in thermal conductivity to the side shell plate 11 and housed in the case 15 (FIG. 5) adapted to preclude thermal conduction in heat flow non-sensing directions are closely attached through soldering to the outer surfaces of the side shell plates 11 forming the aforesaid mold 10, outputs from the heat flux meters 14 are taken into a signal processing device 36 through an extracted heat transducer 34, and the signal processing device 36 is adapted to control the aforesaid pinch roll driving device 32 through a pouring rate control device 38 to reduce the pouring rate when the wave crest H of the heat flux waveform exceeds $300\times 10^4$ Kcal/m$^2$.hr or the amplitude W exceeds $60\times 10^4$ Kcal/m$^2$.hr, thereby enabling to prevent a breakout or a surface crack in the slab from occurring, and simultaneously, to operate an alarming device 40 for giving a predetection alarm to operator.

Figure 8:
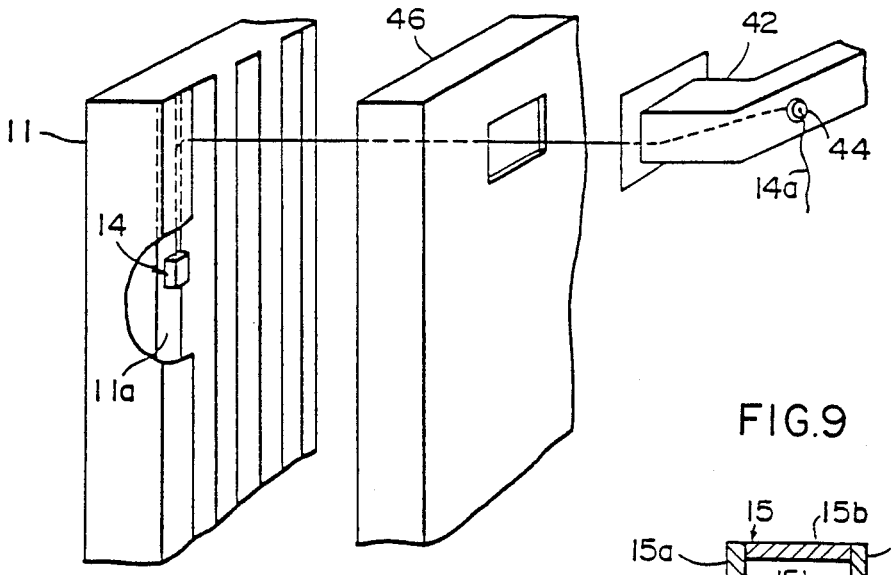
FIG. 8 is a perspective view showing the mounted positions of the heat flux meters in the aforesaid first embodiment.

As detailedly shown in FIG. 8, the aforesaid heat flux meter 14 is provided at the bottom portion in a cooling water path 11*a* formed in an outer side surface of the side shell plate 11, and a heat flux signal line 14*a* is passed through the cooling water path 11*a* and taken out through a water discharge pipe 42 and a seal 44. In FIG. 8, denoted at 46 is a back plate for forming the cooling water path 11*a* behind the side shell plate 11. In addition, in FIG. 8, the heat flux meter signal line 14*a* is taken out through the water discharge pipe 42. However, the method of taking out the heat flux signal line 14*a* need not necessarily be limited to this, but, needless to say, the heat flux signal line 14*a* may be taken out through a water feed pipe, not shown, for example, or directly taken out through the back plate 46.

Figure 9:
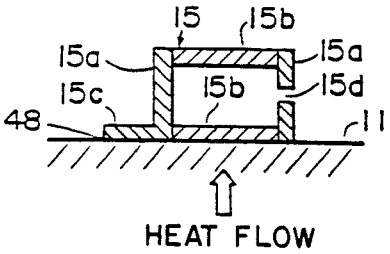
FIG. 9 is sectional view showing configuration of the case hausing the heat flux meter and the mounted state of the case.

As shown in FIG. 9, the aforesaid heat flux meter 14 is housed in a case 30 adapted to preclude heat conduction in heat flow non-sensing directions (directions parallel to the outer surface of the side shell plate 11), having a side surface made of a stainless steel frame plate 15*a* and an upper and a lower surfaces made of copper frame plate 15*b*, respectively, for example, and the bottom surface of the case 15 is solidly secured through a common soldering 48 such as a lead-tin alloy to the outer surface of the side shell plate 11 by the utilization of a soldering iron applying portion 15*c*, whereby the heat flux meter 14 is closely attachedly provided on the side shell plate 11. In the drawing, indicated at 15*d* is an opening for taking out the heat flux meter signal line 14*a*.

The reason why the sensor plates 18 of the heat flux meter 14 are made of the material substantially equal in thermal conductivity to the side side plate 11, such for example as copper similar to the material of the side shell plate 11 is that, if there is a difference in thermal conductivity between the both members, then a turbulence in heat flow is caused, and there will be a possibility of occurrence of an error in the measurement. Furthermore, the upper and lower surfaces 15*b* of the case 15 of the heat flux meter are also made of copper according to the same idea as described above.

Further, the reason why the side surfaces of the case 15 are frame plates 15 made of stainless steel to preclude heat conduction in the heat flow non-sensing directions is that heat is prevented to be relieved in the lateral directions.

Furthermore, the reason why the case 15 is secured through the soldering to the side shell plate 11 is that the both members are fully closely attached to each other without allowing an air layer to be interposed therebetween, so as to improve the thermal conductivity, and moreover, the mounting and detaching can be comparatively easily carried out. In addition, the method of providing the case 15 of the heat flux meter 14 on the mold shell plate 11 need not necessarily be limited to the above, but, may be replaced by bolting for example, as far as the both members can be secured in a state of being closely attached to each other.

Study is made on the size of the heat flux meter suitable for the continuous casting mold. The speed of response of the heat flux meter is about 0.5–1 sec. Consequently, in case a minute longitudinal crack is to be detected, and, if the pouring rate for the continuous cast slab is 1 m/min, then the following equation is established.

$$1000\ \text{mm/min} \times (1/60) \times (0.5\ \text{sec} - 1\ \text{sec}) = 8.3 - 16.7$$

In consequence, 5–20 mm in length is desirable as the size of the heat flux meter. On the other hand, when a great abnormality of the slab, such as a breakout, longitudinal crack or the like is to be detected, the heat flux meter of a small size may be used. However, since the distribution of the heat flux and the change with time are needed, the length of 60–100 m, and more particularly, about 500 mm/6≈80 mm is desirable because the important measuring point is positioned about 500 mm below the meniscus.

Figure 10:
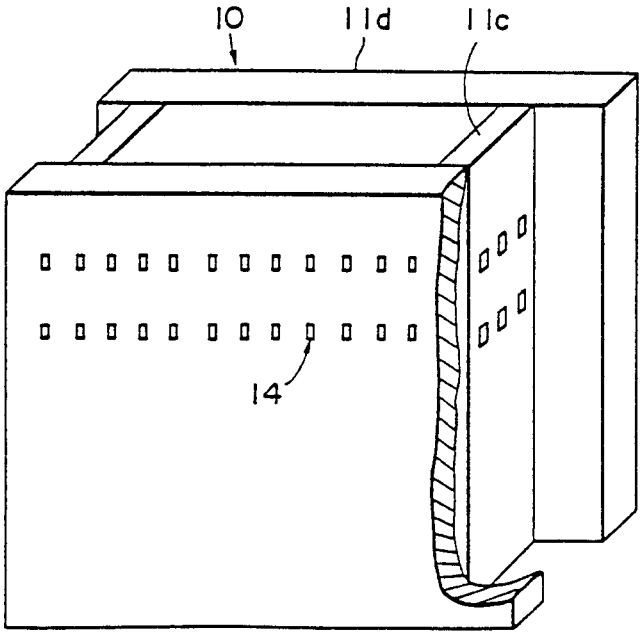
FIG. 10 is a perspective view showing the mounted positions of the heat flux meters.

As shown in FIG. 10 for example, the aforesaid heat flux meters 14 are provided at the short side 11*c* and the long side 11*d* of the mold downwardly of the normal surface of the molten steel, arranged in each of the cooling water paths 11*a* or in every other cooling water path, in the lateral direction, and two or three heat flux meters are disposed at every 100–200 mm in height, in the longitudinal direction.

Description will be given of action.

Figure 11A:
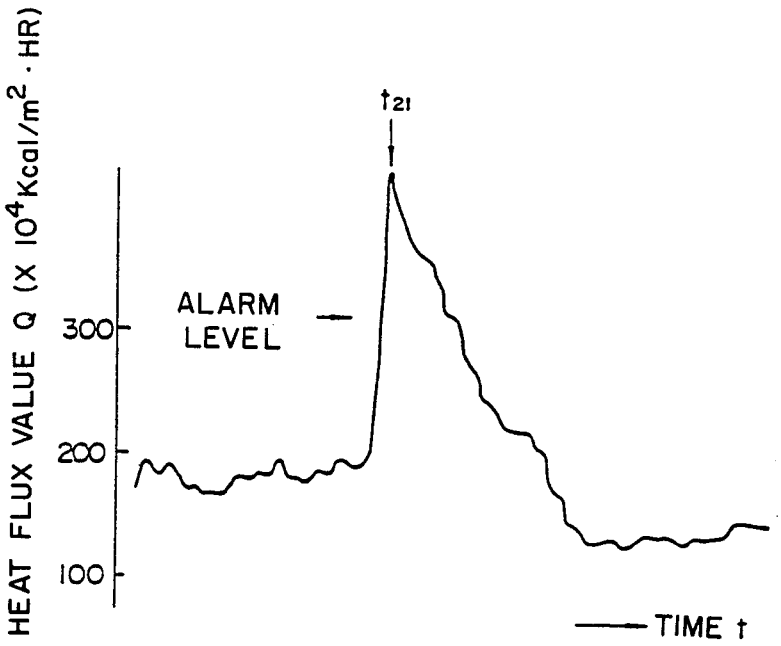
FIG. 11 is a graphic chart showing one relationship between the output from the heat flux meter and the pouring rate.
Figure 11B:
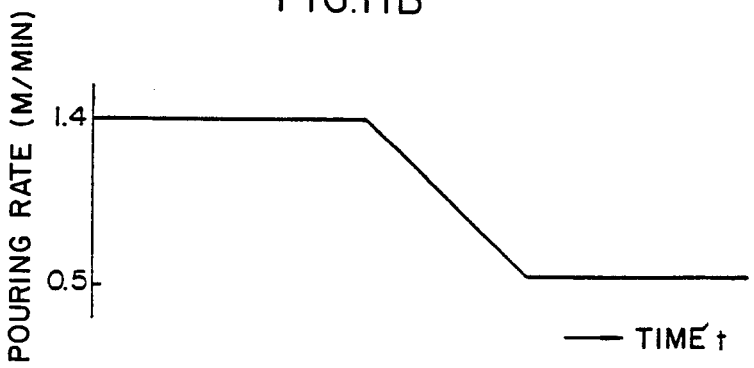

As shown in the afore-mentioned FIG. 10, when the heat flux meters 14 were disposed at positions 100, 300 mm downwardly of the molten steel surface and the operation was conducted at the pouring rate of 1.4 m/min, a high heat flux value was shown at a time point $t_{21}$ as shown in FIG. 11(A), thereby evidently showing that the shell is broken off. Because of this, when the pouring rate was decreased to 0.5 m/min as shown in FIG. 11(B), a satisfactory shell thickness was obtained, thus enabling to prevent a breakout from occurring. In addition, after the satisfactory shell thickness has been obtained, the pouring rate is increased again, thereby enabling to realize the high speed pouring.

Figure 12A:
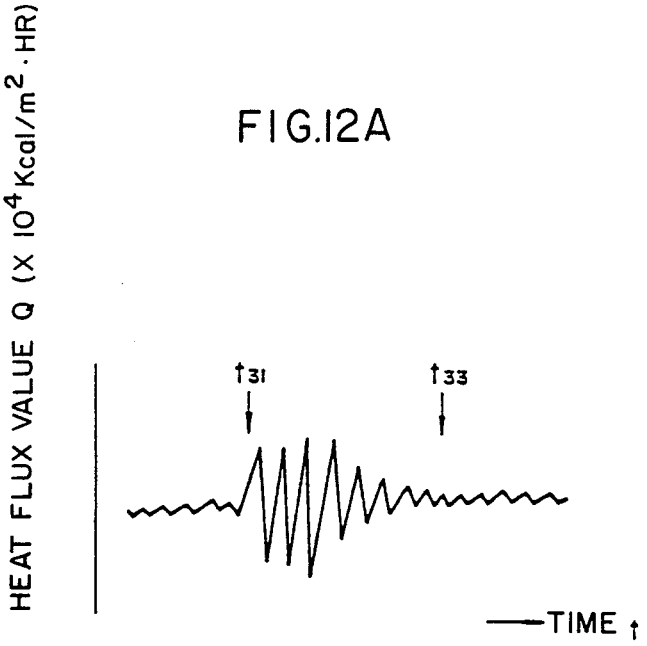
FIG. 12 is a graphic chart showing another relationship between the output from the heat flux meter and the pouring rate.
Figure 12B:
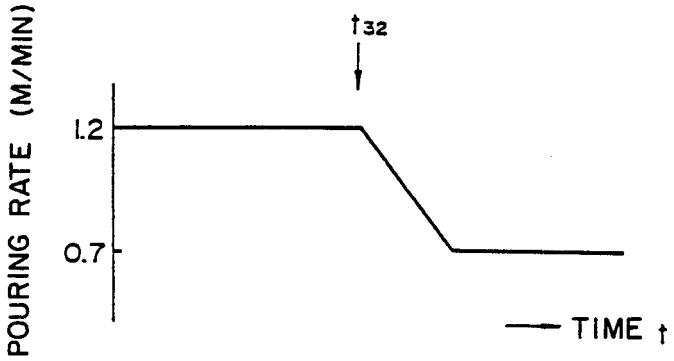

Further, when the operation was conducted at the pouring rate of 1.2 m/min, the amplitude W of the heat flux waveform was abruptly increased in localities from a time point $t_{31}$ as shown in FIG. 12(A). Then, it was found that, when the pouring rate was temporarily decreased to 0.7 m/min from a time slightly later than the time point $t_{31}$, i.e., a time point $t_{32}$ as shown in FIG. 12(B), the amplitude was restored at a time point $t_{33}$ and a surface crack was prevented from occurring as shown in FIG. 12(A). In consequence, the pouring rate can be restored to the original 1.2 m/min from the time point $t_{13}$ to restart the high speed pouring. In addition, when the amplitude becomes large upon the return of the pouring rate to 1.2 m/min, it is possible to prevent a surface crack from occurring through other methods such as the change of mold powder and the like.

In addition, in the above-described embodiment, when any one of outputs from a multiplicity of heat flux meters exceeds a predetermined value, the pouring rate is decreased in response thereto, however, occurrence of a breakout or a crack may be predetected from an output emitted from a single heat flux meter, or occurrence of a breakout or a crack may be predetected due to a general change or an abnormality of the distribution of the extracted heat value of outputs from a multiplicity of heat flux meters.

Furthermore, in the above-described embodiment, occurrences of a breakout and a surface crack in the slab are predetected, and moreover, the pouring rate is automatically decreased so as to prevent a breakout and a surface crack in the slab from occurring. However, the method of applying the present invention is not exclusive and such a method may be adopted that only the occurrence of either a breakout or a crack is predetected and the operating conditions are manually changed by the operator, for example.

Next, detailed description will be given of the second embodiment of the present invention.

Figure 13:
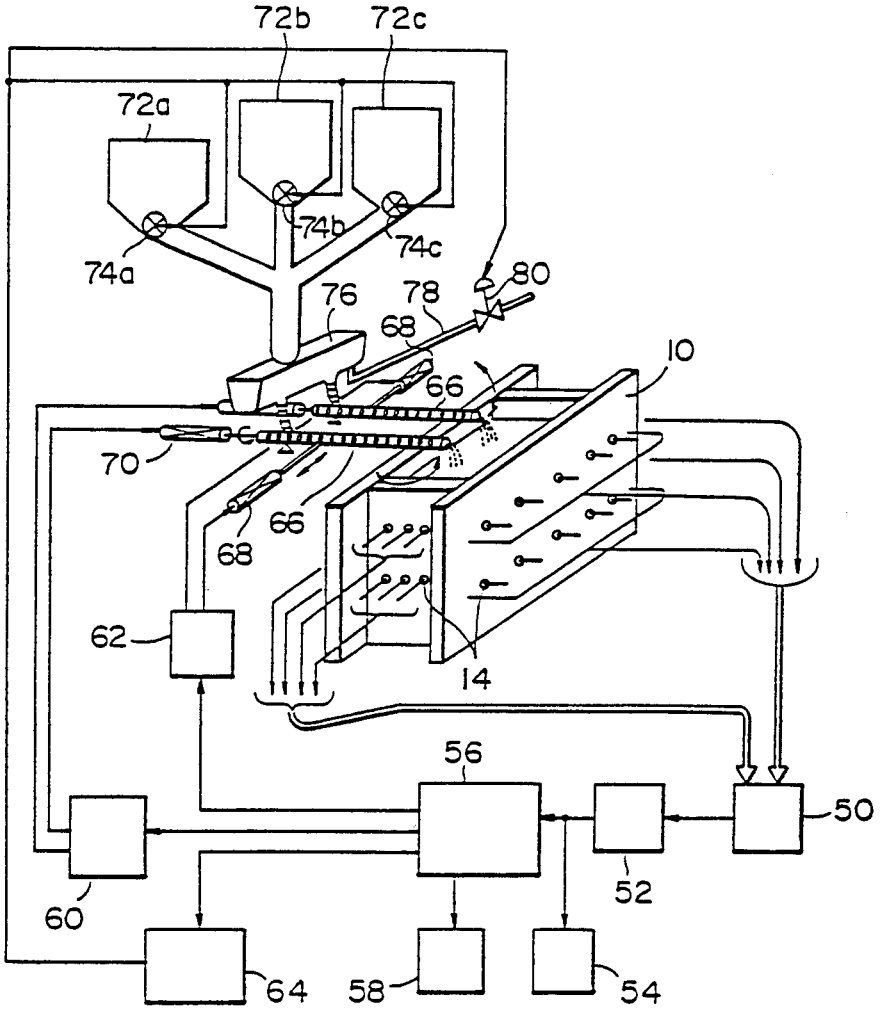
FIG. 13 is a perspective view with a partial block diagram, showing the arrangement of the mold powder supply system in the continuous casting equipment, in which is adapted the second embodiment according to the present invention.

As shown in FIG. 13, the present embodiment comprises: the mold 10 closely attachedly provided on various positions of the outer surface of the mold shell plates thereof with the aforesaid thin plate type surface heat flux meters 14; a signal amplifier 50 for amplifying outputs emitted from the aforesaid heat flux meters 14; a transducer 52 for converting a voltage signal emitted from the signal amplifier into a heat flux signal; a recorder 54 for recording a heat flux waveform emitted from the transducer 52; an operational processing unit 56 for judging an abnormality of a heat flux waveform and emitting an alarm command to an alarming device 58 to inform an operator of the abnormality when the wave crest H and/or the amplitude W, both of which are emitted from the transducer 52, is gone out of the predetermined range, and for judging at what position in the mold 10 an abnormality is present depending on the position of a heat flux meter that emits an abnormal waveform and emitting a command of changing a method of supplying the powder to correct an abnormal portion to a powder supply amount command emitting device 60, a powder supply scope command emitting device 62 and a powder brand command emitting device 64; a powder supply pipe horizontally driving device 68 for driving a powder supply pipe 66 in the horizontal direction, so that the position of the powder supply pipe 66, the position of which has been detected by a powder supply pipe position detecting device, not shown, can be located at a predetermined position, to thereby concentrically supply a precribed optimum amount of powder within the specified scope in response to a powder supply scope command signal emitted from the powder supply scope command emitting device 62; a powder supply pipe rotation driving motor 70 for varying a rotational speed of the powder supply pipe 66 of a screw rod shape to increase or decrease the powder supply amount in response to a powder supply amount command signal emitted from the powder supply amount command emitting device 60; powder discharge feeders 74*a* through 74*c* for respectively controlling discharge amounts of hoppers 72*a* through 72*c* provided for respective brands, for example, in response to a powder brand command output emitted from the powder brand command emitting device 64; an intermediate hopper 76 for mixing the powder discharged from the hoppers 72*a* through 72*c*; and an aeration gas amount regulating valve 80 for regulating a gas amount supplied through an aeration piping 78 so as to facilitate the mixing in the intermediate hopper 76 in response to a powder mixing command output emitted from the powder brand command emitting device 64.

The arrangement of the aforesaid heat flux meters 14, the mounted states thereof, the configuration of the case and the mounted positions are same as the aforesaid first embodiment, so that description is omitted.

Figure 4:
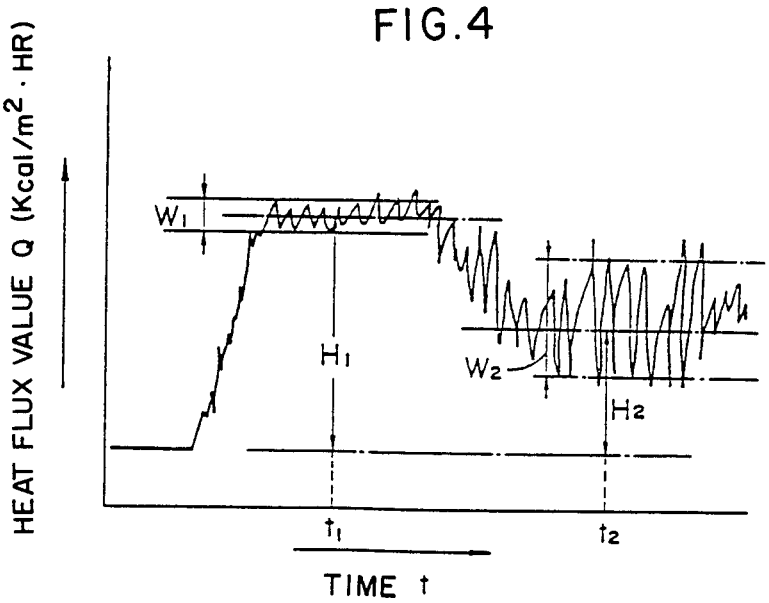
FIG. 4 is a graphic chart showing an example of the heat flux waveform obtained by the aforesaid heat flux meter.

The aforesaid operational processing unit 56, to state specifically, commands to keep the operating conditions as they are, when the heat flux waveform as shown in FIG. 4 is obtained, that is, a wave crest $H_1$ and an amplitude $W_1$ at a time point $t_1$, for example, are $100\times10^4$ Kcal/m$^2$.hr$<H_1<300\times10^4$ Kcal/m$^2$.hr and $W_1<60\times10^4$ Kcal/m$^2$.hr, respectively, and no possibilities of occurrences of a breakout and surface defects of the slab is predetected. However, when a wave crest $H_2$ and an amplitude $W_2$ of the heat flux waveform, which are observed at a time point $t_2$, for example, are $H_2<100\times10^4$ Kcal/m$^2$.hr, $H_2>300\times10^4$ Kcal/m$^2$.hr or $W_2>60\times10^4$ Kcal/m$^2$.hr, and these conditions continue 30 sec or more, and regarded as a symptom of occurrence of abnoramal phenomenon, changes of the supply amount of the powder, supply scope of the powder and the like intended for the position, where the abnormality is detected, are command to various components.

Description will hereunder be given of action.

When the molten steel 24 is poured into the mold 10, a heat flow is generated from the molten steel 24 to the mold 10 in the mold 10. This heat flow is varied depending on a gap formed between the mold 10 and the molten steel 24, the thickness of a powder film which flows into the aforesaid gap, the temperature of the molten steel, the amount of mold cooling water and so forth. The heat flux value is measured by the heat flux meters 14 embedded in various positions in the cooling water paths of the mold 10. An input signal thus measured is amplified by the signal amplifier 50, and thereafter, converted into a heat flux signal by the transducer 52. The signal thus converted is recorded by the recorder 54 and, in the operational processing unit 56, the wave crest and amplitude of the waveform are analyzed. These analyses may be made on individual outputs of the multiplicity of heat flux meters, or may be made on the average value of two or three heat flux meters so as to improve the measuring accuracy. When an abnormality is detected as the results of analyses on the wave crest and amplitude in the operational processing unit 56, that is, the wave crest H is less than $100\times10^4$ Kcal/m$^2$.hr or exceeds $300\times10^4$ Kcal/m$^2$.hr, or the amplitude W exceeds $60\times10^4$ Kcal/m$^2$.hr, a command of changing the method of supplying the powder is emitted to the powder supply amount command emitting device 60, powder supply scope command emitting device 62 or/and powder brand command emitting device 64. The powder supply scope command emitting device 62 drives the powder supply pipe 66 in the horizontal direction through the powder supply pipe horizontally driving device 68 in response to a powder supply scope command emitted from the operational processing unit 56, so that an optimum amount of powder can be concentrically supplied within a specified scope. With this arrangement, the portions, to which the powder in small quantities flows in, can be immediately avoided. Additionally, the powder supply amount command emitting device 60 changes the rotational speed of the powder supply pipe rotation driving motor 70 in response to a powder supply amount change command emitted from the operational processing unit 56, whereby the rotational speed of the powder supply pipe 66 is changed, so that the powder supply amount can be increased or decreased. With this arrangement, shortage or excess of the powder flow-in can be avoided. In addition, the method of changing the supply amount of the powder need not necessarily be limited to this, and a change of the moving speed of the powder supply pipe 66 also change the supply amount of the powder, for example.

Additionally, when an abnormality in the heat flux waveform is not obviated even by the adjustment of the powder supply amount and the supply scope, a powder brand change command or a powder mixing command is emitted from the operational processing unit 56 to the powder brand command emitting device 64. With this arrangement, the powder discharge feeders **74*a*–74*c* of the hoppers 72*a*–72*c* of suitable brands are operated, whereby the brands are changed. Further, when the mixing of the powder brands is necessary, the powder, which has been discharged from a plurality of hoppers, is mixed in the intermediate hopper 76, and thereafter, supplied into the mold 10. This mixing is stirred by a gas through the aeration pipe 78, and the regulation of the amount of the mixing gas is carried out by the aeration gas regulating valve 80**.

According to the research made by the present inventors, according to the conventional method, minute longitudinal cracks or a breakout has not been obviated. However, according to the method of the present invention, the minute longitudinal cracks or a breakout can be reliably obviated.

Next detailed description will be given of the third embodiment of the present invention.

Figure 14:
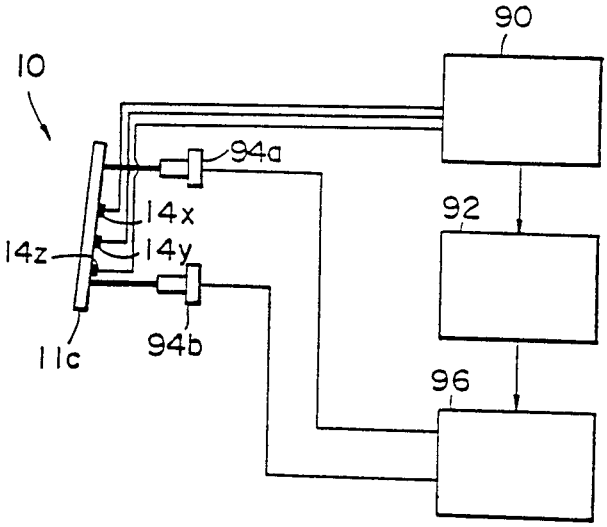
FIG. 14 is a block diagram showing the arrangement of the system of controlling the taper value of the short sides of the mold in the continuous casting equipment, to which is applied third embodiment according to the present invention.

As shown in FIG. 14, the present invention comprises: thin plate type surface heat flux meters **14*x*, 14*y* and 14*z* closely attachedly provided at a plurality of positions, e.g., three positions in the vertical direction on the short side shell plate 11*c* of the mold 10; a transducer 90 for converting outputs from the heat flux meters 14*x*, 14*y* and 14*z* into heat flux signals; a signal processing unit 92 for calculating a correction value for the taper value of the mold short side from a deviation between the target value and the heat flux values at three positions in the vertical direction on the mold short side in response to an output from the transducer 90; and a short side drive control unit 96 for controlling hydraulic cylinders 94*a* and 94*b* provided upwardly and downwardly of the short side shell plate 11*c* of the mold, respectively, in response to an output from the signal processing unit 92, to thereby control the taper value of the short side shell plate 11*c*** of the mold.

Figure 15:
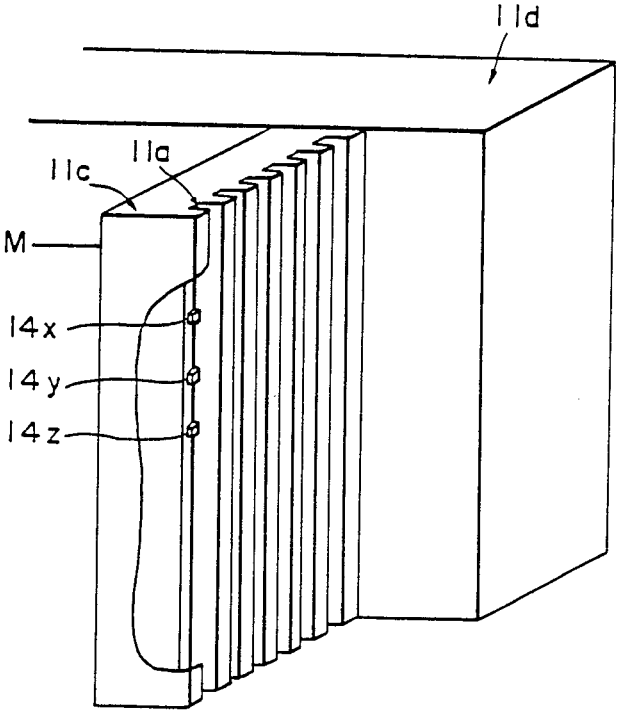
FIG. 15 is a perspective view showing the arrangement of the heat flux meters in the aforesaid third embodiment.

A shown in FIG. 15 in detail, the aforesaid heat flux meters **14*x*, 14*y* and 14*z* are provided at three positions in the vertical direction on the short side shell plate 11*c* of the mold 10. For example, the heat flux meter 14*x* is provided at a position 150 mm downward from the molten steel surface M in the mold 10, the heat flux meter 14*y* at a position 400 mm downward from M and the heat flux meter 14*z* at a position 650 mm downward from M. Additionally, one heat flux meter may be provided in the widthwise direction of the short side shell plate 11*c*. However, in the present embodiment, the heat flux meters are provided at three positions in the widthwise directions of channels at the center and opposite sides out of the cooling water paths 11*a* formed in the short side shell plate 11*c*, i.e., nine positions in total. In FIG. 15, denoted at 11*d* is a long side shell plate of the mold 10**.

Description will hereunder be given of action.

Figure 16A:
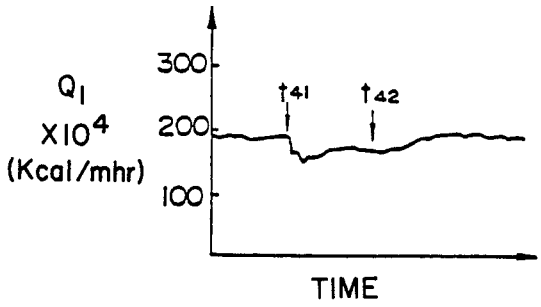
FIG. 16 are graphic charts showing examples of changes in outputs of the heat flux meters when the grades of steel are changed.
Figure 16B:
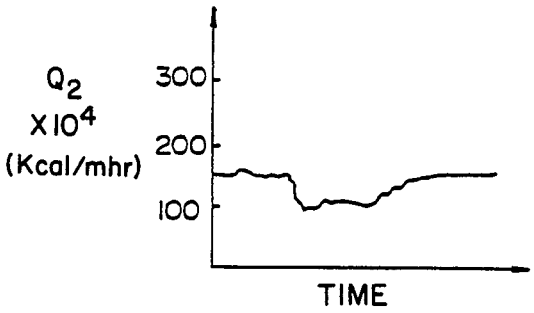
Figure 16C:
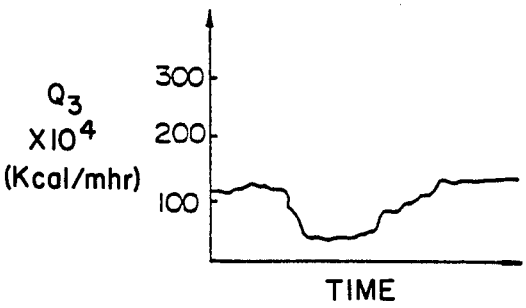

When the molten steel 22 is poured into the mold 10, a heat flow is generated from the molten steel 22 to the mold 10 in the mold 10. This heat flow is varied depending on a gap formed between the mold 10 and the molten steel 22, the thickness of a powder film which flows into the aforesaid gap, the temperature of the molten steel, the amount of mold cooling water and so forth. Now, as shown in FIGS. 16(A), 16(B) and 16(C), when a change of the grade of steel was conducted at a time point $t_{41}$ into a grade of steel ununiform in development of the shell and high in shrink characteristics in the peritectic zone of C 0.12–0.16%, the heat flux values $Q_1$, $Q_2$ and $Q_3$ detected by the respective heat flux meters 14*z*, 14*y* and 14*z* were reduced in the lowering direction. In consequence, when the taper value changed from a time point $t_{42}$, whereby the heat flux values were returned to the target values, so that a satisfactory operation was achieved. In addition, as a specific method of controlling the taper value commensurate to the heat flux value detected by each heat flux meter, there is such a method, as shown in the following equation for example, wherein the taper value TP can be determined as commensurate to a deviation betweeen the detected values Qn of the respective heat flux meters and the target value $Q_o$ of the heat flux from the function f determined on the basis of the experience.

$$TP=f(Qn-Qo) \quad (4)$$

Figure 17A:
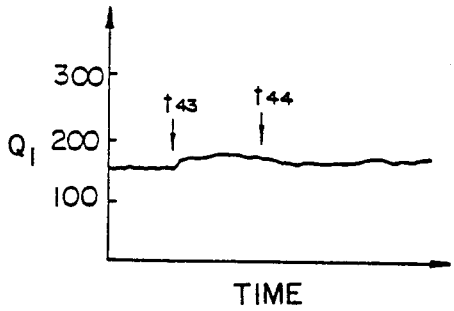
FIG. 17 are graphic charts showing examples of changes in outputs of the heat flux meters when the pouring rates are changed.
Figure 17B:
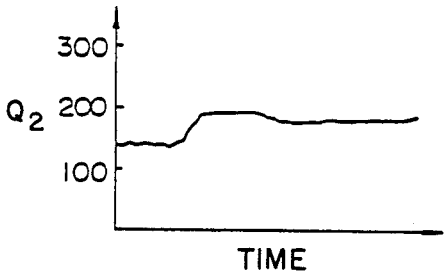
Figure 17C:
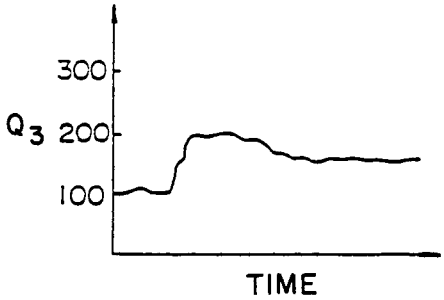

Additionally, as shown in FIGS. 17(A), 17(B) and 17(C), when the mold powder was changed at a time point $t_{43}$ and the pouring rate was raised from 1.0 m/min to 1.5 m/min, the heat flux values $Q_1$, $Q_2$ and $Q_3$ detected by the respective heat flux meters 14*x*, 14*y* and 14*z* were increased. It is thought that this occurred due to the fact that the value of shrinkage of the solidified shell in the mold was decreased with the rise in the pouring rate, whereby the frinctional force between the solidified shell and the mold was increased. In consequence, when the taper value was gradually decreased from a time point $t_{44}$ and the taper value was set so that a target heat flux value suitable for the pouring rate 1.5 m/min was obtained, a satisfactory operation was achieved.

In addition, in the above-described embodiment, the heat flux meters have been provided at three positions in the vertical direction and at three positions in the widthwise direction of the short side shell plate 11*c* of the mold 10, i.e., nine positions in total. However, the positions of provision and number of provision of the heat flux meters need not necessarily limited to the above.

Capability of Exploitation in Industry

As has been described hereinabove, the method of controlling continuous casting equipment according to the present invention is useful for preventing a breakout or/and a crack of the slab of continuous casting equipment. And the method is particularly suitable for use in controlling pouring rate, supply of mold powder or taper value of short side of mold.

We claim:

1. A method of controlling continuous casting equipment, comprising the steps of:

providing a heat flux meter on an outer surface of a side shell plate of a mold;

measuring a local heat flux waveform commensurate to a local extracted heat value of said mold with said heat fux meter;

detecting an abnormality of said local heat flux waveform; and adjusting the operation of said equipment responsive to said detection of an abnormality.

2. A method according to claim 1, wherein occurrence of at least one of a breakout and a crack of a slab is predetected by said detection of an abnormality, and said occurrence is prevented by said adjustment.

3. A method according to claim 1, wherein said heat flux meter is a thin plate type surface heat flux meter.

4. A method according to claim 1, wherein said heat flux meter is selected to have a sensor plate made of a material substantially equal in thermal conductivity to said side shell plate.

5. A method according to claim 1, wherein a cooling water path is formed on said outer surface;

said heat flux meter is provided in said cooling water path and is connected to a heat flux meter signal line; and said signal line is extended through said cooling water path and at least one of a water feed pipe, a water discharge pipe and a mold back plate.

6. A method according to claim 1, wherein said heat flux meter is housed in a case which precludes heat conduction in heat flow non-sensing directions.

7. A method according to claim 2, wherein said abnormality is an abnormality of a wave crest of said local heat flux waveform, said adjustment is an adjustment of pouring rate, and said occurrence is an occurrence of a breakout.

8. A method according to claim 2, wherein said abnormality is an abnormality of an amplitude of said local heat flux waveform, said adjustment is an adjustment of pouring rate, and said occurrence is an occurrence of a crack.

9. A method according to claim 1, wherein a plurality of heat flux meters is provided at various positions on said side shell plate and a plurality of local heat flux waveforms is measured at various portions of said mold.

10. A method according to claim 9, wherein said adjustment comprises adjusting at least one of a supply and a mixture ratio of mold powder.

11. A method according to claim 9, wherein said side shell plate is a short side shell plate of a short side of said mold, comprising the further steps of:

calculating deviations between predetermined target values and said local extracted heat values;

calculating a taper value of said short side of said mold from said deviations; and controlling said taper value by means of said adjustment to avoid occurrence of at least one of a breakout, a crack of a slab and wear of said mold.

* * * * *